US005908373A

United States Patent [19]

Pitre

[11] Patent Number: 5,908,373

[45] Date of Patent: Jun. 1, 1999

[54] FULL BODY EXERCISE APPARATUS

[76] Inventor: John Pitre, 1515 Ualakaa Pl., Honolulu, Hi. 96822

[21] Appl. No.: 08/838,531

[22] Filed: Apr. 9, 1997

[51] Int. Cl.[6] ..... A63B 22/00; A63B 21/00

[52] U.S. Cl. ..... 482/57; 482/62; 482/52

[58] Field of Search ..... 482/57, 62, 51, 482/52–53, 148, 908

[56] References Cited

U.S. PATENT DOCUMENTS

| | | | |
|---|---|---|---|
| 1,344,963 | 6/1920 | Ruden | 482/62 |
| 3,704,886 | 12/1972 | Kay et al. | 482/62 |
| 3,759,511 | 9/1973 | Zinkin et al. | 272/58 |
| 4,390,180 | 6/1983 | Simjian | 272/126 |
| 4,555,109 | 11/1985 | Hartmann | 482/62 |
| 4,563,001 | 1/1986 | Terauds | 272/72 |
| 4,586,706 | 5/1986 | Chen | 482/62 |
| 4,630,817 | 12/1986 | Buckley | 482/62 |
| 4,728,099 | 3/1988 | Pitre | 482/52 |
| 4,940,233 | 7/1990 | Bull et al. | 272/130 |
| 4,961,569 | 10/1990 | Roberge | 482/62 |
| 5,039,088 | 8/1991 | Shifferaw | 272/73 |
| 5,076,572 | 12/1991 | Wang | 272/70 |
| 5,163,888 | 11/1992 | Stearns | 482/110 |
| 5,387,169 | 2/1995 | Wang | 482/73 |
| 5,419,751 | 5/1995 | Byrd et al. | 482/138 |
| 5,460,586 | 10/1995 | Wilkinson et al. | 482/54 |
| 5,487,709 | 1/1996 | Froelich, Sr. et al. | 482/46 |
| 5,527,253 | 6/1996 | Wilkinson et al. | 482/147 |
| 5,540,637 | 7/1996 | Rodgers, Jr. | 482/52 |
| 5,545,111 | 8/1996 | Wang et al. | 482/53 |
| 5,573,480 | 11/1996 | Rodgers, Jr. | 482/57 |
| 5,575,739 | 11/1996 | Piaget et al. | 482/51 |
| 5,595,553 | 1/1997 | Rodgers, Jr. | 482/51 |
| 5,595,555 | 1/1997 | Chen | 482/51 |
| 5,669,856 | 9/1997 | Liu | 482/51 |
| 5,704,878 | 1/1998 | Chen | 482/52 |
| 5,733,227 | 3/1998 | Lee | 482/52 |
| 5,749,807 | 5/1998 | Webb | 482/52 |
| 5,749,809 | 5/1998 | Lin | 482/52 |

*Primary Examiner*—Stephen R. Crow
*Attorney, Agent, or Firm*—Nikaido Marmelstein Murray & Oram LLP

[57] ABSTRACT

An improved full body exercise apparatus generally includes a frame with a front portion and a rear portion, wherein the front and rear portions together define a longitudinal axis. The front and rear portions are coupled for rotatable engagement, and a pair of handle bars is connected to the front portion and adapted to be rotated about a vertical axis which intersects the longitudinal axis at such coupling means. A pair of pedal arms, each of which is connected to respective pivot points together define a transverse axis at a distal end of the rear portion. The transverse axis is so positioned relative to the longitudinal axis and the vertical axis to optimize physical workouts of a user of the apparatus.

28 Claims, 11 Drawing Sheets

FULL BODY EXERCISE APPARATUS

BACKGROUND OF THE INVENTION

1. Field of the Invention

The present invention relates generally to apparatus for exercising specific parts of the human anatomy, and more particularly to improved exercise apparatus which enables a compound exercise movement for conditioning a cross-section of muscle groups in a general, full body workout.

2. Statement of the Prior Art

Exercise machines of all shapes and sizes are well known in the prior art. One particularly effective full body exercise apparatus according to this prior art is disclosed in U.S. Pat. No. 4,728,099, entitled "Variable Resistance Exercise Apparatus" and granted on Mar. 1, 1988 to John H. Pitre. Such apparatus generally provides a longitudinally oriented frame having a front end and a rear end, a seat carried on the frame in a forward facing position such that it is capable of carrying a user in a forward facing position with respect to the frame, a foot rest carried by the frame forward of the seat and adapted to receive, in use, the user's feet with legs in a generally forwardly extended position, a pair of hand engageable push/pull handles having one handle located on each of the right and left sides of the seat, each handle being carried by the frame for longitudinal movement approximately between at least the longitudinal positions of the seat and foot rest and for lateral movement approximately between at least a juxtaposed central position and a separated position, a variable resistance apparatus employing a flywheel with centrifugal clutches for variably opposing forces applied longitudinally to the handles, and a diverting mechanism for laterally and yieldably redirecting a portion of forces applied longitudinally to the handles. The push/pull handles pass through a center of balance at an intermediate point of longitudinal travel and, when moving forward of such center, apply gravitationally assisted inertia to stretch the user. A leg exerciser operates from the same flywheel to simulate the full range leg movement of steep climbing.

While commercial embodiments of such apparatus according to U.S. Pat. No. 4,728,099 have achieved a great deal of success, they are relatively difficult and expensive to manufacture, equally difficult and expensively set up and used, and mechanically complex in their design so as to require complicated flywheels and the like.

SUMMARY OF THE INVENTION

Accordingly, it is a general object of the present invention to provide improved exercise apparatus which enables a compound exercise movement for conditioning a cross-section of muscle groups in a general, full body workout.

More particularly, it is an exercise object of the present invention to provide apparatus for exercising specific parts of the human anatomy.

A further object of the present invention is to provide a full body exercise apparatus which is relatively easy and inexpensive to manufacture, equally easy and inexpensively set up and used, and mechanically simple in its design.

These and other objects, advantages, and novel features according to the present invention are provided by an improved full body exercise apparatus which generally comprises a frame with a front portion and a rear portion, wherein the front and rear portions together define a longitudinal axis. The front and rear portions are coupled for rotatable engagement, and a pair of handle bars is connected to the front portion and adapted to be rotated about a vertical axis which intersects the longitudinal axis at such coupling means. A pair of pedal arms, each of which is connected to respective pivot points together define a transverse axis at a distal end of the rear portion. The transverse axis is so positioned relative to the longitudinal axis and the vertical axis to optimize physical workouts of a user of the apparatus.

Ideally, the improved full body exercise apparatus as disclosed herein functions to precisely guide its user through a highly effective workout for the complete body in a very short period of time through implementation of natural, full range motions for all muscles while thoroughly engaging the user's cardiovascular system.

Further aspects, details and features of a presently preferred embodiment of the invention will become readily apparent from the following detailed description thereof, when considered in conjunction with the accompanying drawings wherein:

DETAILED DESCRIPTION OF THE INVENTION

Figure 1:
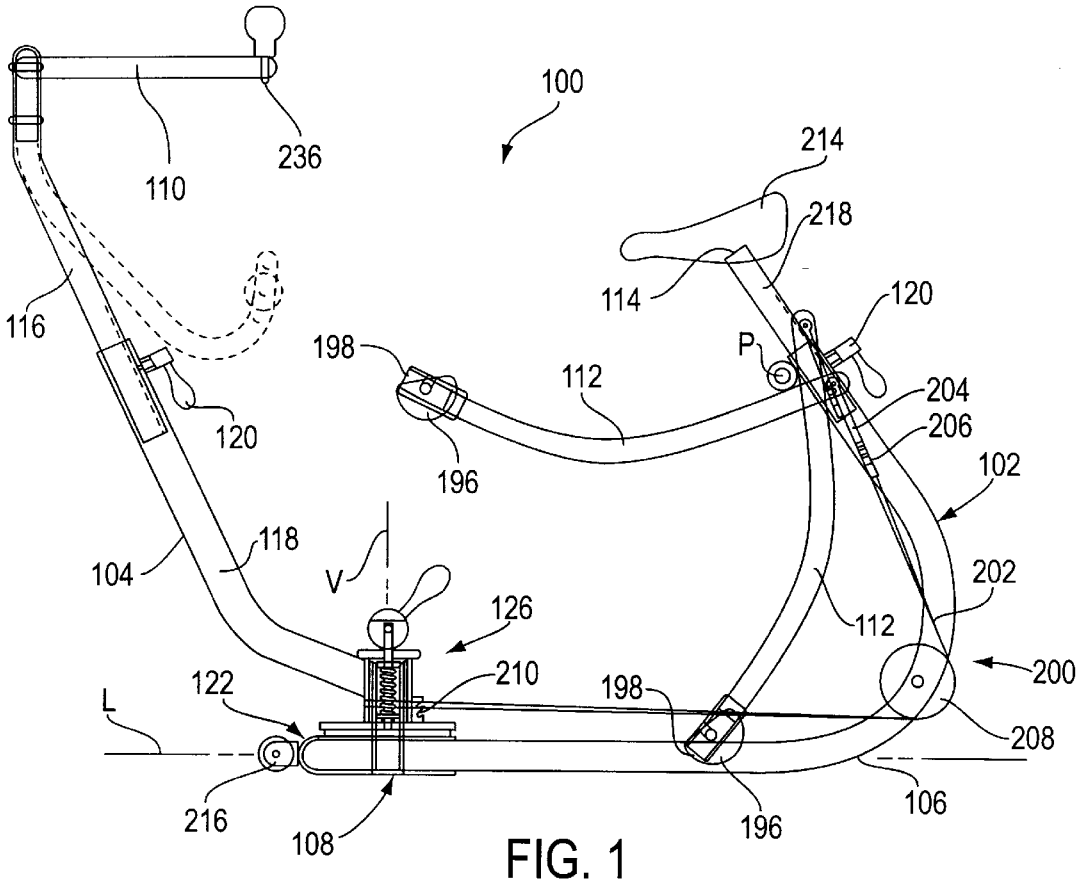
FIG. 1 is a side view of the improved full body exercise apparatus according to a presently preferred embodiment of the invention.

Referring now to the drawings, wherein like characters designate like or corresponding parts throughout the several views, there is shown in FIG. 1 a full body exercise apparatus 100 according to a presently preferred embodiment of the invention. Apparatus 100 generally comprises a frame 102 having a front portion 104 and a rear portion 106, together defining a longitudinal axis L, and a suitable means 108 which as more fully described herein below is provided for coupling the front portion 104 to the rear portion 106 in rotatable engagement therewith. A pair of handle bars 110, connected to the front portion 104, is adapted to be rotated about a vertical axis V which intersects the longitudinal axis L at coupling means 108. Each one of a pair of pedal arms 112 is connected to its respective pivot point P, such that a transverse axis T (FIGS. 2 and 3) is defined by the pivot points P proximate to the distal end 114 of the rear portion 106.

Figure 6:
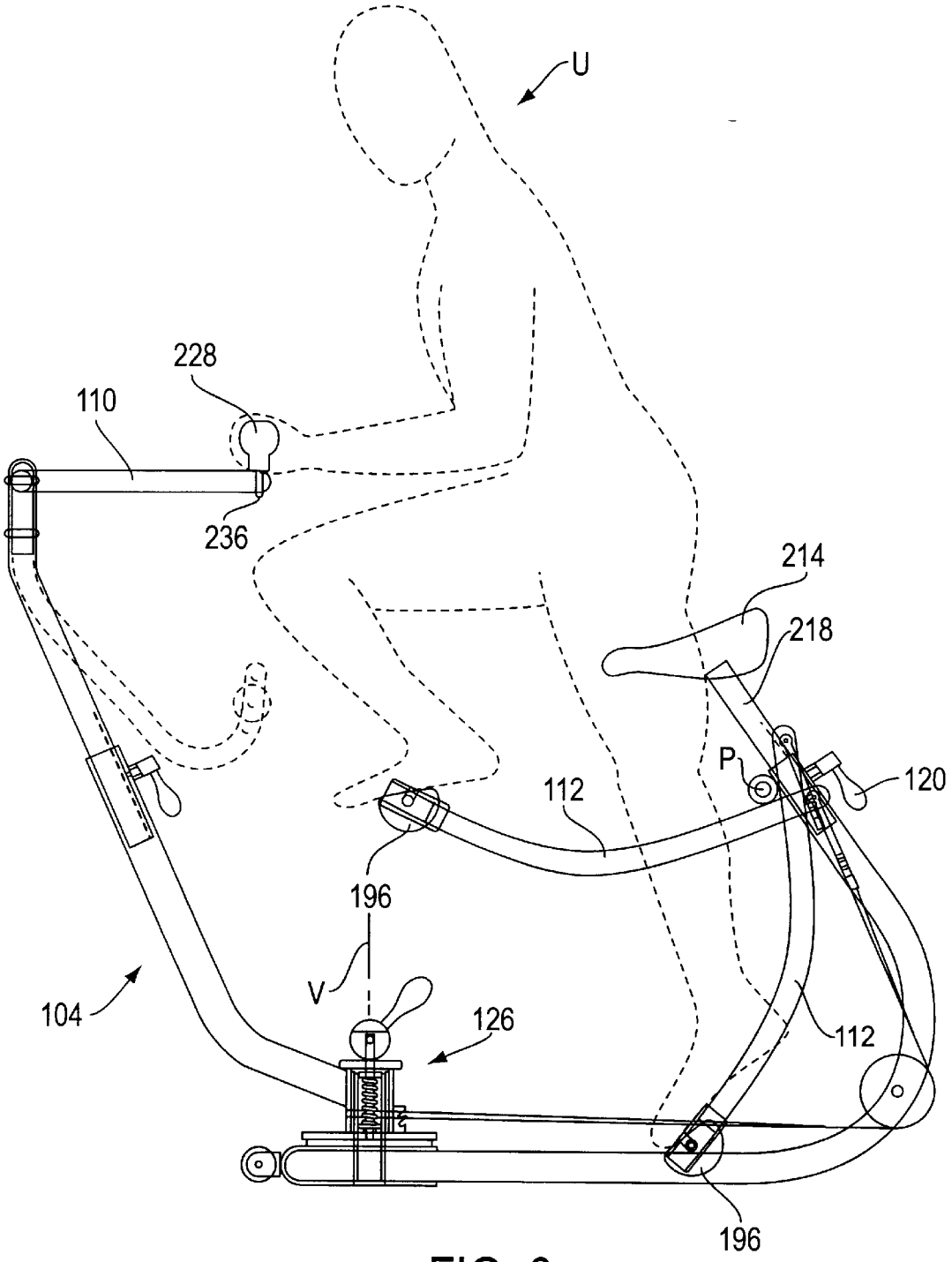
FIG. 6 is a side view of the improved full body exercise apparatus as employed by a user.
Figure 7:
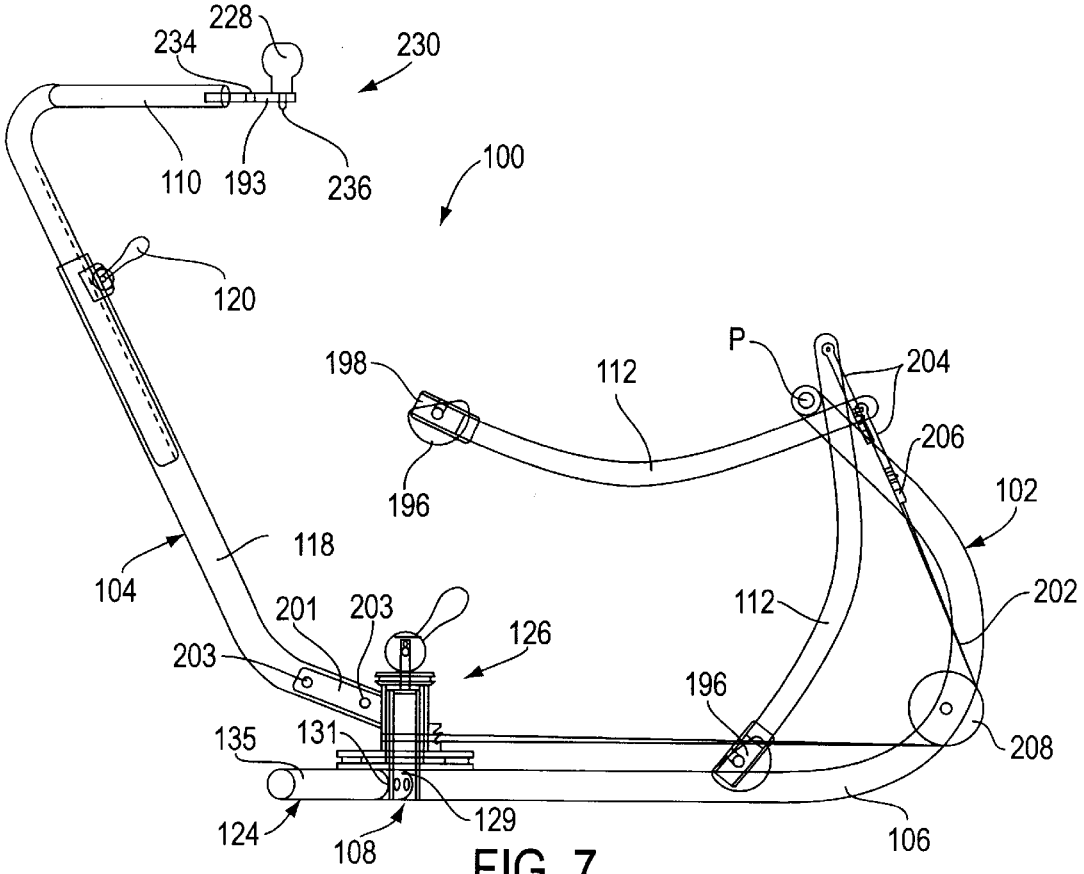
FIG. 7 is a side view of the improved full body exercise apparatus according to another embodiment of the present invention.
Figure 8:
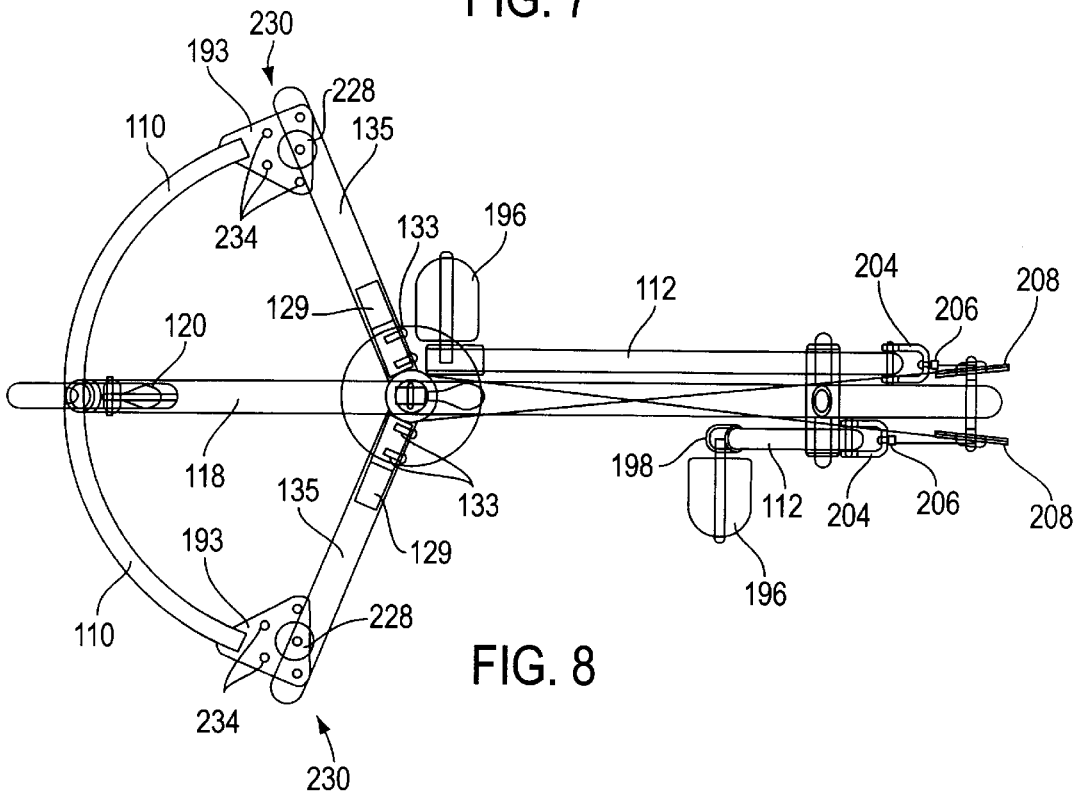
FIG. 8 is a top view of the improved full body exercise apparatus shown in FIG. 7.
Figure 9:
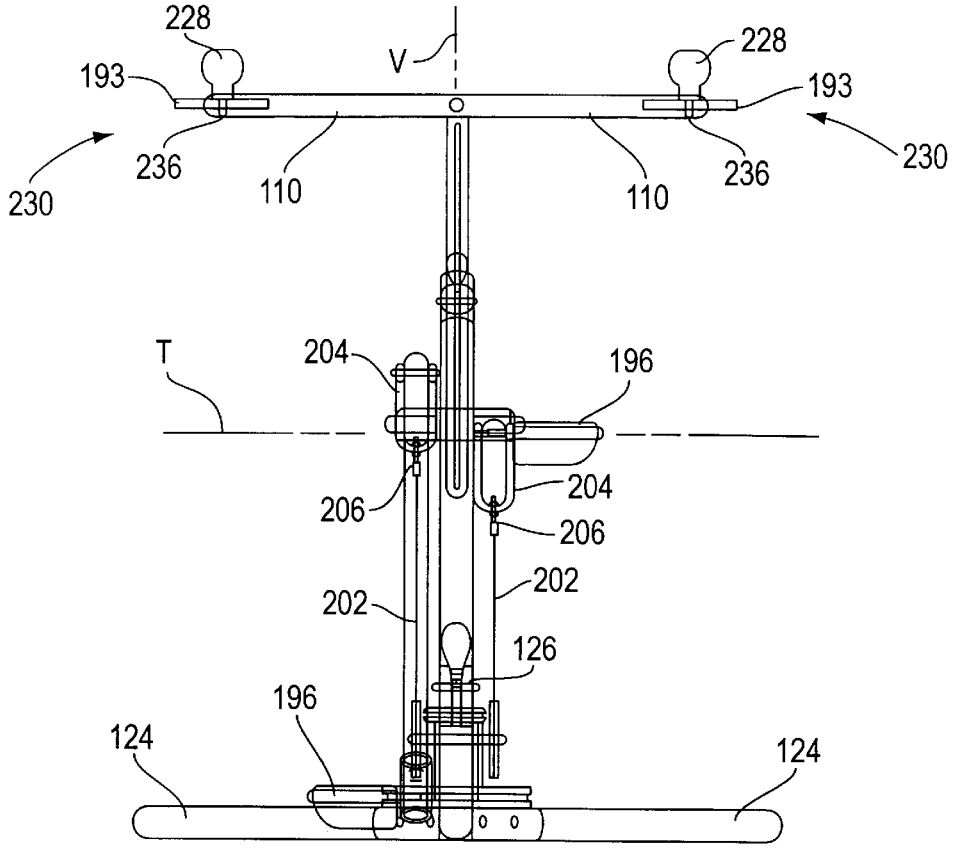
FIG. 9 is an end view of the improved full body exercise apparatus shown in FIGS. 7 and 8.

In accordance with one important aspect of the present invention, the transverse axis T is positioned relative to the longitudinal axis L and the vertical axis V for optimizing physical workouts of a user of the apparatus. Known apparatus for exercising the legs simultaneously with the upper body of a user in accordance with the prior art, including the aforementioned U.S. Pat. No. 4,728,099 and stair-stepping devices such as those manufactured by StairMaster Sports/Medical Products, Inc. of Kirkland, Wash., conventionally pivot from a position in front of and well below the hips of the user. In each of the embodiments according to the present invention, however, its transverse axis T and, therefore, the pivot point P of each pedal arm 112 is uniquely positioned behind the hips of a user U as shown in FIG. 6.

The inventor herein has determined through careful analysis that a most effective way to obtain compound exercise movement while conditioning a cross-section of muscle groups in a general, full body workout is by mimicking runners climbing steep grades or steps at the rate of two to three at a time. In such a manner, the full body exercise apparatus according to the present invention not only maintains the natural planes of motion of a user's arms and legs, but also permits such user's arms and legs to undergo their fullest possible ranges of motion.

One means of accomplishing the above movements is to position the handle bars 110 at a suitable height. Most suitably, user U would position the handle bars 110 at a height above the floor corresponding to the lower part of the user's rib cage while standing erect. This would assure that, in use, the handle bars 110 would be from about six to twelve inches below the height of the user's shoulders. Such a positioning optimally induces back-and-forth movement of the user's arms in a natural plane not unlike martial arts training or boxing (i.e., punch throwing) when the upper body or front portion 104 of the apparatus 100 is in use. Moreover, during such use of the front portion 104 to exercise a user's upper body, this positioning of the handle bars 110 substantially rotates the user's torso, further maximizing the overall benefits of the exercise.

Figure 2:
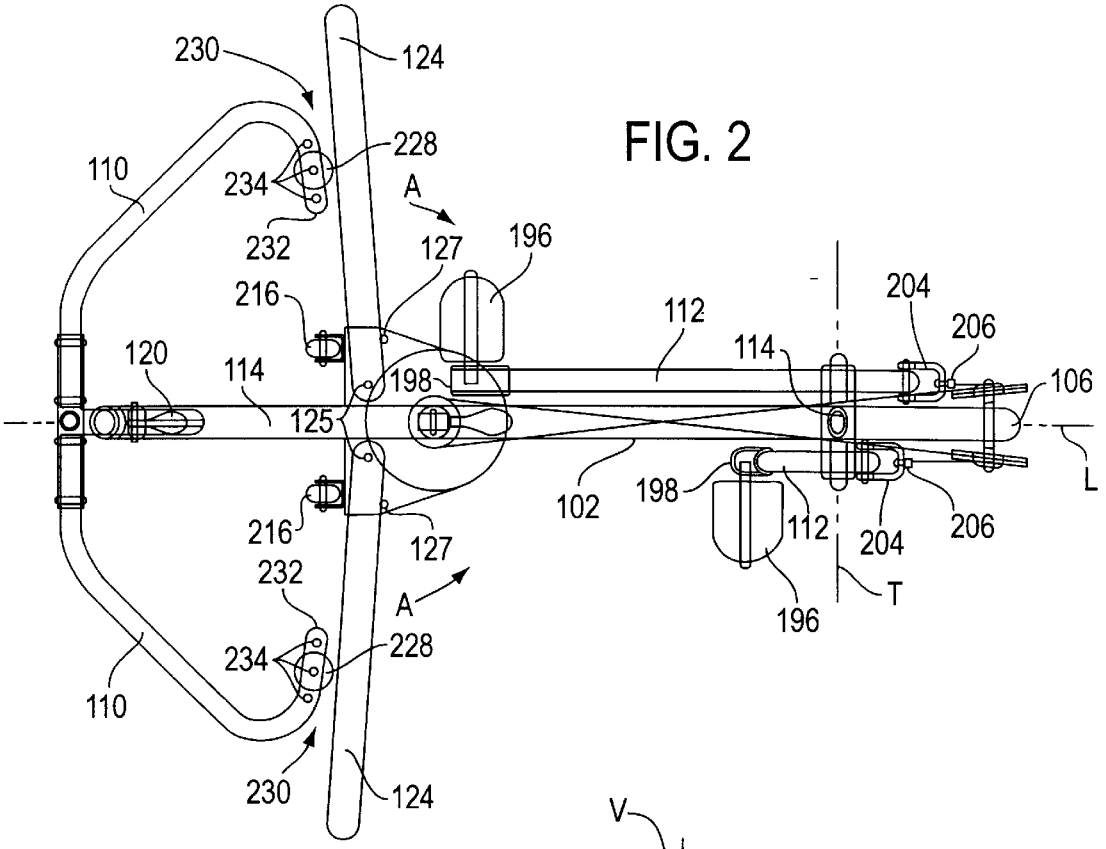
FIG. 2 is a top view of the apparatus shown in FIG. 1.
Figure 3:
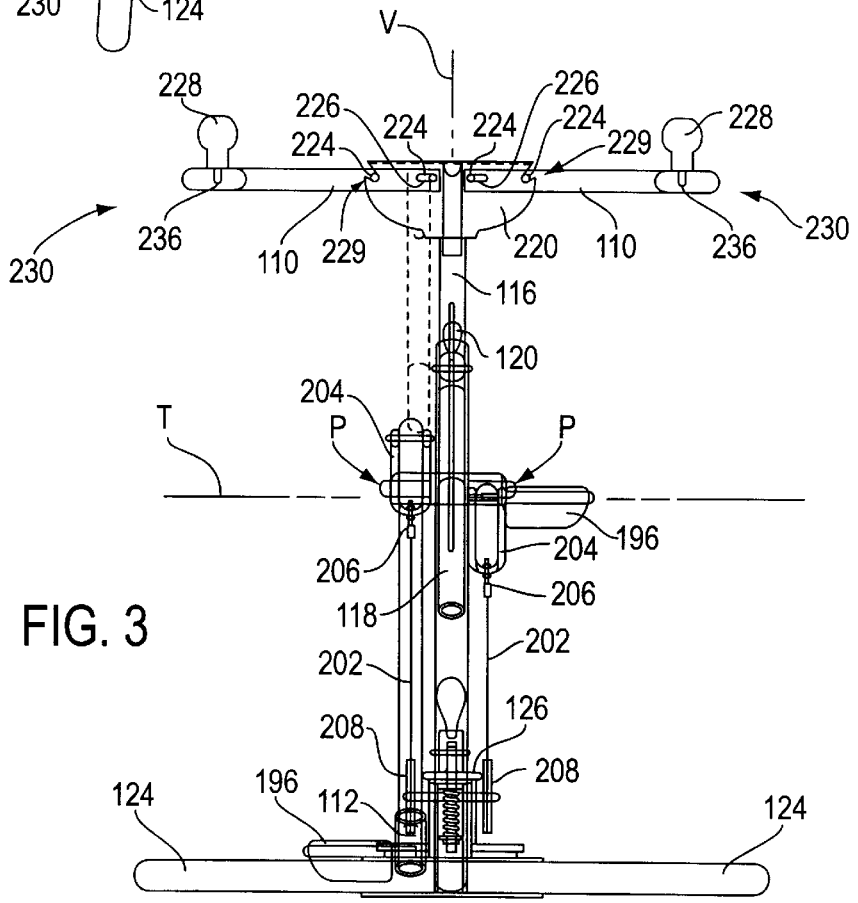
FIG. 3 is an end view of the apparatus shown in FIGS. 2 and 3.

Apparatus 100 achieves the above objectives by attaching the handle bars 110 to a first tubular member 116 slidably engaged within a second tubular member 118 which is, in turn, attached (e.g., by welding) to the coupling means 108. A conventional clamp means 120 is used to adjustably position the relative position of the first tubular member 116 within second tubular member 118. Apparatus 100 further comprises means 122 for stabilizing the apparatus 100 in use. Such stabilizing means 122 suitably comprises a pair of legs 124 (FIGS. 2 and 3), each of which forms an outwardly extending appendage of the front portion 104 in a substantially orthogonal relationship with the longitudinal axis L and the vertical axis V. Referring now more specifically to FIGS. 2 and 3, it can be seen that each leg 124 is pivotally coupled to the coupling means 108 in order to permit such legs 124 to be folded back (in the direction of the arrows A shown in FIG. 2) against the rear portion 106 of the frame 102. The legs 124 pivot about respective pins 125, and are held in place by spring-loaded locking pins 127. In order to conveniently stow the apparatus 100 with its legs 124 folded back against the frame 102, a user merely needs to push each locking pin 127 in and pivot its associated leg 124 back in the direction of the arrows A.

Figure 4:
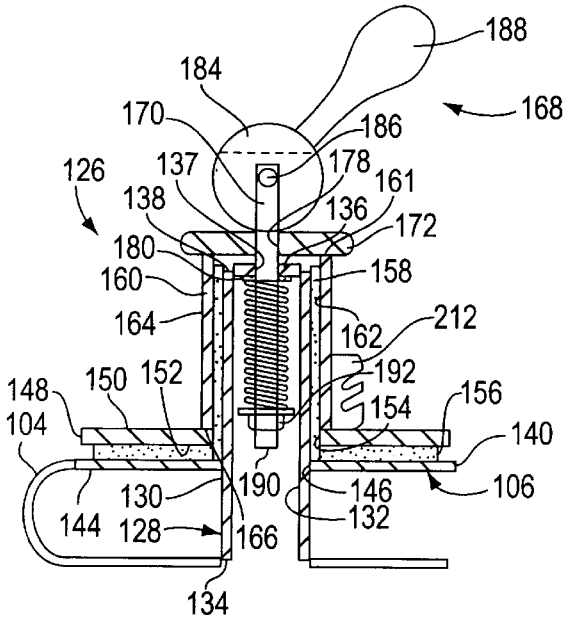
FIG. 4 is a side view, partly in section, of the clutch apparatus shown in FIGS. 1–3.
Figure 5:
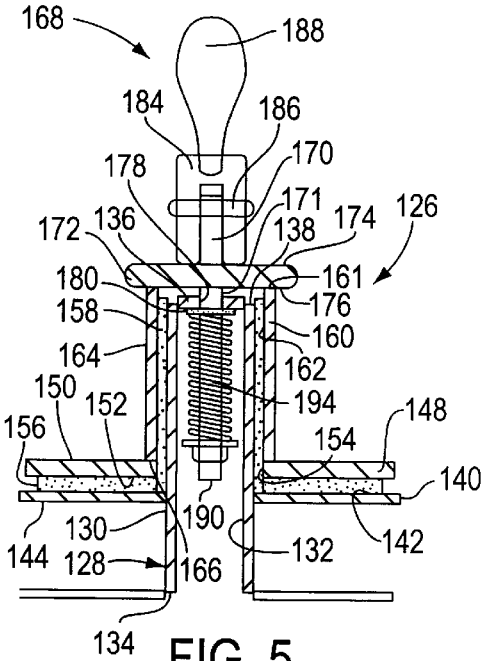
FIG. 5 is a front view, partly in section, of the clutch apparatus shown in FIGS. 1–4.

As shown more specifically in FIGS. 4 and 5, the coupling means 108 according to this presently preferred embodiment of the invention preferably comprises a spring-actuated clutch 126. The resistance clutch 126 firstly comprises a spindle tube 128 having an outer surface 130 and an inner surface 132. Spindle tube 128 is connected at one end 134 thereof to the front portion 104 and the rear portion 106 and includes a plug 136 enclosing its other end 138. The resistance clutch 126 secondly comprises a first pressure disc 140 having a top surface 142, a bottom surface 144, and a central hole 146 through which the spindle tube 128 extends. Bottom surface 144 is connected to the front portion 104 and the rear portion 106. For example, the spindle tube 128 may be suitably connected to the rear portion 106 by welding.

Resistance clutch 126 thirdly comprises a second pressure disc 148 having a top surface 150, a bottom surface 152, and a central hole 154 through which the spindle tube 128 extends. A clutch disc 156 comprising any suitable material (e.g., metals such as cast iron, bronze and steel, felt, wood, cork, leather and synthetic variants thereof) is thereafter positioned between the first and second pressure discs 140, 148. A first bearing means 158, preferably made of a suitable bronze, contiguously surrounds the spindle tube 128 along a length of its outer surface 130 extending from the top surface 142 of the first pressure disc 140 to the other end 138 of the spindle tube 128. An outer sleeve 160, having an inner surface 162 and an outer surface 164, surrounds the first bearing means 158 such that its inner surface 162 is in contiguous contact with the first bearing means 158, and is connected at one end 166 thereof to the second pressure disc 148. Thereafter, a means 168 for quickly adjusting the pressure exerted by the second pressure disc 148 is provided in accordance with another important aspect of the present invention.

Such pressure adjusting means 168 preferably comprises a cam support 170 coupled through plug 136, a cam pressure plate 172 having a top surface 174, a bottom surface 176, and a central hole 178 through which the cam support 170 extends, second bearing means 180, and a cam 184 coupled to the cam support 170 and for selectably engaging the top surface 174 of the cam pressure plate 172 and causing same to exert pressure downwardly through the outer sleeve 160 upon the top surface 150 of the second pressure disc 148. Plug 136 includes a central hole 137 through which the cam support 170 slidably extends, and is welded to the other end 138 of spindle tube 128 in any conventional manner. Likewise, the bottom surface 176 of the cam pressure plate 170 may be suitably connected (such as by welding) to the outer sleeve 160 at its other end 161.

Conveniently, the cam 184 is coupled for rotation upon the cam support 170 by an axle 186 held in place with retaining rings (not shown), and further comprises a handle 188 which may be integrally formed as a part of the cam 184. At the distal end 190 of cam support 170, threads (not shown) are provided for reception of and engagement by a spring adjustment nut 192. First, however, a clutch spring 194 is mounted about the cam support 170 to engage, proximate to one end 171 thereof, the second bearing means 180 (preferably a bronze washer in this embodiment). The spring adjustment nut 192 is then threaded upon the cam support 170 at its distal end 190, to adjust the effective tension range of the cam 184 as at exerts force on the clutch.

Referring again to FIGS. 1–3 and 6, each pedal arm 112 further comprises a pedal 196 which is rotatably connected to a distal end 198 of the pedal arm 112 and adapted to support a foot of the user U throughout the full range of motion of the user's legs. In accordance with yet another important aspect of the present invention, each pedal 196 is also adapted to be folded inwardly toward the longitudinal axis L in order to facilitate use of the front portion 104 of apparatus 100 without using the rear portion 106. User U would thus stand upon the floor slightly behind the coupling means 108 and rotate the front portion 104 from side to side, using a pushing and pulling motion with both arms.

Means 200 for making minor adjustments to the range of motion of the user's legs are also provided in accordance with still another important aspect of the present invention. Such range of motion adjusting means 200 are interdependently coupled for movement with the coupling means 108 by using a pair of cables 202 (e.g., aircraft cables), each end of which is attached to a respective one of the pedal arms 112 by cable attachment brackets 204 and cable length adjustment mechanisms 206. Each cable 202 is wound about its respective pulley 208 and attached to the coupling means 108 by way of a slot 210 formed in a cable catch bracket 212 (FIG. 4) welded to the outer sleeve 160. A swaged fitting (not shown) at the end of each cable 202 provides a convenient method of attaching the cables 202 within the slots 210 formed in the cable catch bracket 212.

As can also be seen from FIGS. 1 and 6, the presently preferred embodiment of the apparatus 100 according to the invention herein further comprises a seat 214 attached to the distal end 114 of the rear portion 106, a pair of foldable handle bars 110, and wheels 216 attached to the front portion 104 for assisting the user U in moving the apparatus 100 from place to place. The seat 214 is suitably attached to a length of tubing 218 which is adjustably coupled at the distal end 114 of the rear portion 106 by clamp means 120 similar to the type used to adjust the height of the handle bars 110. User U merely employs the seat 214 for purposes of resting and stability when mounting, as the seat 214 is not normally intended to be used while exercising.

The handle bars 110, as shown in FIGS. 1–3 and 6, are capable of being folded down out of the way when the apparatus 100 is not in use. They are also capable of adjustment in height to conform to the size of a particular user U as described herein before. In accordance with this presently preferred embodiment of the invention, a plate 220 is fixed to the first tubular member 116 in a plane generally perpendicular to the floor. Each handle bar 110 is slidably mounted to the plate 220 and held in place by a pair of pins 224. The pins 224 closest to the centerline of the apparatus 100 are fixed to respective ones of the handle bars 110, and slidably engage a slot 226 formed in plate 220. The other, outermost pins 224 may be spring-loaded or fixed and engage respective detents 229 formed in the plate 220. In order to fold the handle bars 110 in a stowed position (as shown in FIGS. 1, 3 and 6), the user U pulls each handle bar 110 outwardly from the centerline of the apparatus 100 in order to disengage the outermost pins 224 from detents 229. Each handle bar 110, in this intermediate position, would then be capable of being folded downwardly through means of pins 224 rotating within their respective slots 226.

Each handle bar 110 further comprises a hand grip 228, and receiving means 230, at the distal end 232 of the handle bar 110, for variably positioning the hand grip 228 to emphasize one or more selected muscle groups to be exercised by the user U, and to accommodate various body sizes. Such receiving means 230 according to this presently preferred embodiment merely comprises a plurality of holes 234 formed in the handle bars 110, and the hand grip 228 includes a pin 236 which is adapted to fit within each of the holes 234. A spring-loaded locking pin (not shown) or other suitable such locking device may be included within the pin 236 to provide a means for securing the hand grip 228 in place.

With the apparatus fully deployed and adjusted to accommodate a specific user U (i.e., where the handle bars 110 are at a height above the floor corresponding to the lower part of the user's rib cage while standing erect, and the hand grips 228 appropriately positioned), the user U first engages the clutch 126 (or other suitable such variable resistance means) to provide suitable resistance. He then mounts the apparatus 100 (as shown in FIG. 6) by placing each foot on a corresponding pedal 196, grasps the hand grips 228, and begins to step. As a given pedal arm 112 goes down, the handle bar 110 on the side opposite to such downwardly moving pedal arm 112 rotates about vertical axis V, and the user's hand, while gripping the hand grip 228 on such opposite side nearly touches the side of the user's torso proximate to the bottom of his rib cage.

It should be noted at this juncture that FIG. 6, for the sake of simplicity, shows the front portion 104 and handle bars 110 in their centered and neutral position. In use, where the pedal arms 112 and their corresponding pedals 196 are positioned as shown in FIG. 6, the front portion 104 would be rotated substantially ninety degrees to the right about vertical axis V such that the user's right hand would be nearly touching the user's torso proximate to the bottom of his rib cage.

For example, as the right leg of user U approaches its nearly fully contracted and raised position as shown in FIG. 6, the right hand of user U grasping the right-side hand grip 228 will ideally touch or nearly touch the right side of his torso just below the user's rib cage. In this position, the user's right arm will likewise be fully retracted, thereby exercising the pulling muscles of his upper body. The user U then steps down with his right leg, forcing his left leg up, and rotating the front portion 104 substantially 180° about the vertical axis V, such that the user's left hand grasping the left-side hand grip 228 will ideally touch or nearly touch the left side of his torso just below the user's rib cage. In this position, the user's left leg will be nearly fully contracted, his right leg will be nearly fully extended, his left arm will be nearly fully retracted, and his right arm will be nearly fully extended. User U continues to alternately step up and down on the pedals 196 of the rear portion 106 of apparatus 100, rotating his torso by holding on to the hand grips 228 while pushing and pulling both arms in unison with his legs. In accordance with still another important aspect of the present invention, a user U merely has to maintain such a routine for a period of as short as three minutes to enable a compound exercise movement for conditioning a cross-section of muscle groups in a general, full body workout.

Referring now to FIGS. 7–11, there is shown therein apparatus 100 according to a second embodiment of the present invention. It can be seen in this embodiment that each leg 124 is preferably comprised of a tubular front leg mount 129 having a pair of holes 131 adapted for reception of any suitable fastening means 133 such as rivets, screws, or bolts, and a solid metal rod 135 adapted for insertion within its respective leg mount 129 and connected thereto by such fastening means 133. The front portion 104 and handle bars 110 are also connected to coupling means 108 by means of a front slide tube mount 201 welded to the outer sleeve 160. In such a manner, the second tubular member 118 can be slidingly coupled over the front slide tube mount 201, and held in place by any conventional fastening means 203 such as rivets, screws, nuts and bolts (not shown). It should also be noted that the apparatus according to this second embodiment lacks a seat.

Figure 10:
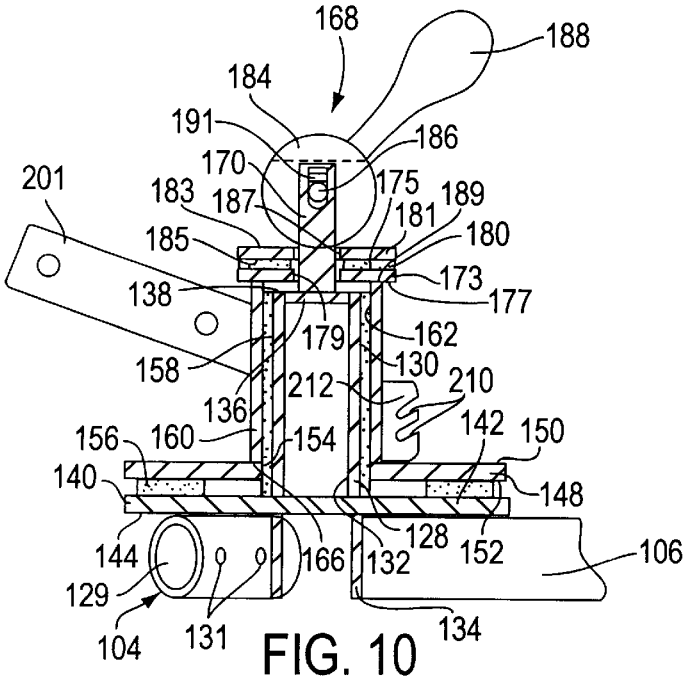
FIG. 10 is a side view, partly in section, of the clutch apparatus shown in FIGS. 7–9.
Figure 11:
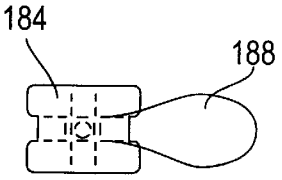
FIG. 11 is a top view of the cam handle illustrated in the clutch apparatus shown in FIG. 10.

As shown more specifically in FIGS. 10 and 11, the coupling means 108 preferably also comprises a resistance clutch 126. Such resistance clutch 126 according to this embodiment, however, firstly comprises a spindle tube 128 having an outer surface 130 and an inner surface 132, wherein the spindle tube 128 is connected at one end 134 thereof to the front portion 104 and the rear portion 106 and includes a plug 136 enclosing its other end 138. This resistance clutch 126 secondly comprises a first pressure disc 140 having a top surface 142, a bottom surface 144, and a central hole 146 through which the spindle tube 128 extends, wherein the bottom surface 144 is connected to the front portion 104 and the rear portion 106. For example, the spindle tube 128 may be suitably connected to the front portion 104 and the rear portion 106 by welding such spindle tube 128 to the leg mounts 129, the curvilinear solid metal rod comprising rear portion 106 of the frame 102, and the bottom surface 144 of the first pressure disc 140.

The resistance clutch 126 according to this second embodiment thirdly comprises a second pressure disc 148 having a top surface 150, a bottom surface 152, and a central hole 154 through which the spindle tube 128 extends. A clutch disc 156 comprising any suitable material (e.g., metals such as cast iron, bronze and steel, wood, cork, leather and synthetic variants thereof) is thereafter positioned between the first and second pressure discs 140, 148. A first bearing means 158, preferably made of a suitable bronze, contiguously surrounds the spindle tube 128 along a length of its outer surface 130 extending from the top surface 142 of the first pressure disc 140 to the other end 138 of the spindle tube 128. An outer sleeve 160, having an inner surface 162 in contiguous contact with the first bearing means 158, is connected at one end 166 thereof to the second pressure disc 148. Thereafter, a means 168 for quickly adjusting the pressure exerted by the second pressure disc 160 is also provided.

Such pressure adjusting means 168 according to this second embodiment preferably comprises a cam support 170 connected to the plug 136, a first bearing disc 173 having a top surface 175, a bottom surface 177, and a central hole 179 through which the cam support 170 extends, a second bearing disc 181 having a top surface 183, a bottom surface 185, and a central hole 187 through which the cam support 170 extends, second bearing means 180 between the first bearing disc 173 and the second bearing disc 181, and a cam 184 coupled to the cam support 170 for selectably engaging the top surface 183 of the second bearing disc 181 and causing same to exert pressure through the second bearing means 180 and the first bearing disc 173, downwardly through the outer sleeve 160 upon the top surface 150 of the second pressure disc 148. The cam support 170 may be integrally formed as a part of the plug 136, or welded thereto in any conventional manner. Likewise, the bottom surface 177 of the first bearing disc 173 may be suitably connected (such as by welding) to the outer sleeve 160 at its other end 189. Conveniently, the cam 184 is coupled for rotation upon the cam support 170 by an axle 186 held in place with retaining rings (not shown), and further comprises a handle 188 which is integrally formed as a part of the cam 184. A set screw 191 is also used to adjust the effective tension range of the cam 184 as at exerts force on the clutch.

In accordance with yet another important aspect of the present invention, and referring again to FIGS. 7–9, each of the pair of handle bars 110 further comprise a hand grip 228, and receiving means 230, connected to a distal end 232 of the handle bar 110, for variably positioning the hand grip 228 to emphasize one or more selected muscle groups to be exercised by the user U, and to accommodate various body sizes. Such receiving means 230 in this second embodiment comprises a plate 193 having a plurality of holes 234 and the hand grip 228 includes a pin 236 which is adapted to fit within each of the holes 234. A spring-loaded locking pin (not shown) or other suitable such locking device may be included within the pin 236 to provide a means for securing the hand grip 228 in place.

Figure 12:
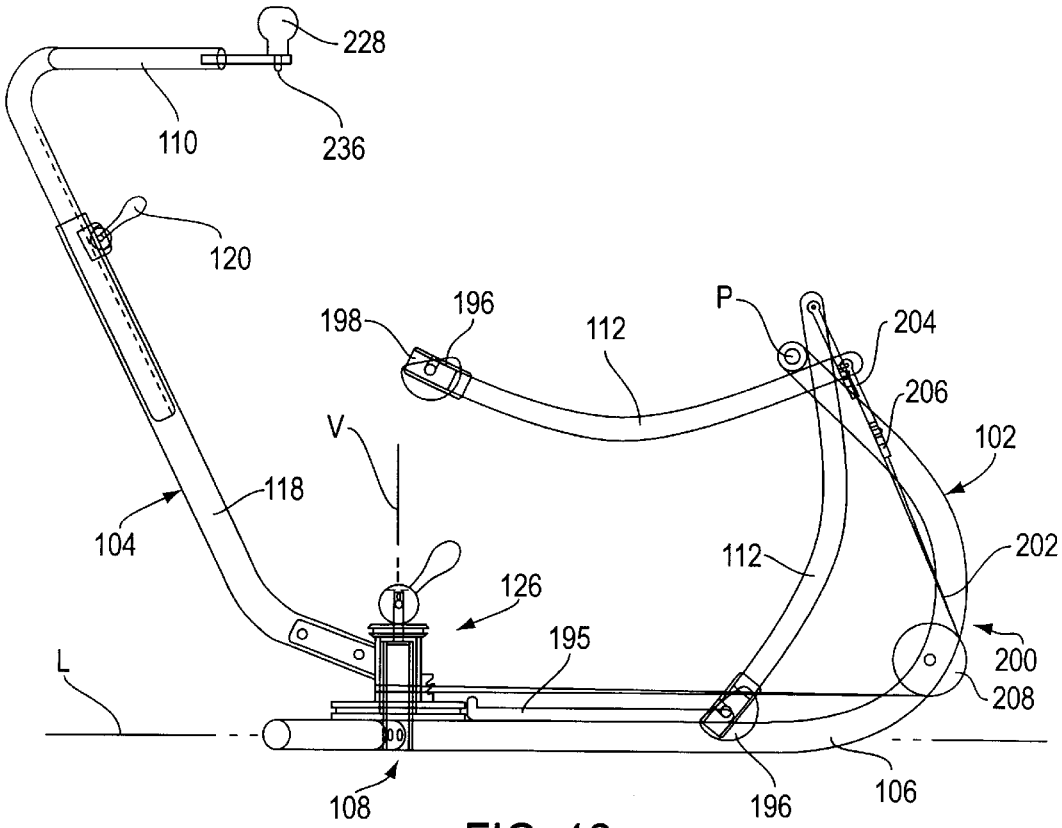
FIG. 12 is a side view of the improved full body exercise apparatus according to still another embodiment of the present invention.
Figure 13:
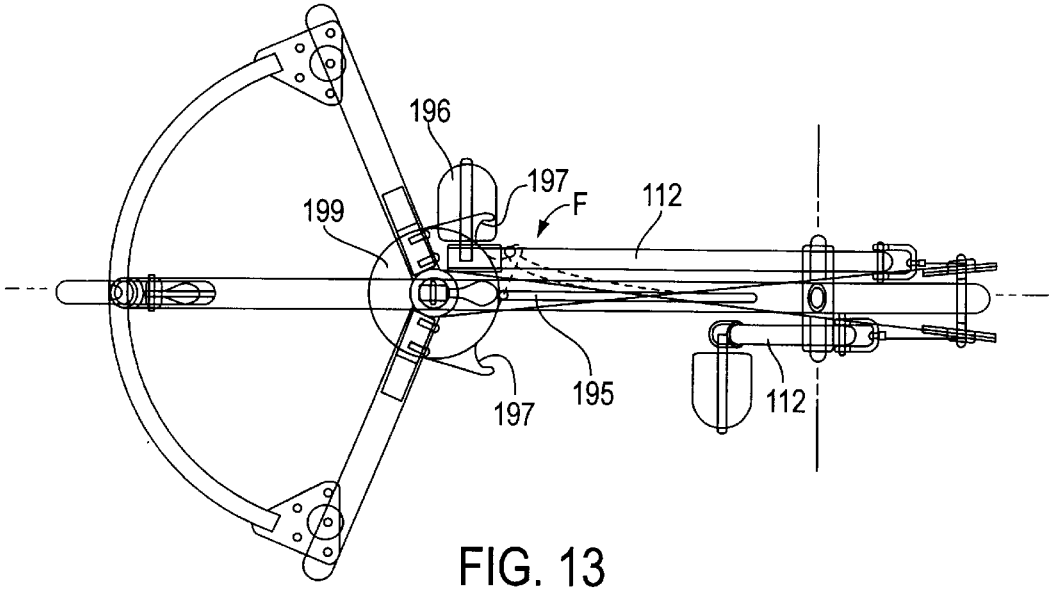
FIG. 13 is a top view of the improved full body exercise apparatus shown in FIG. 12.

Referring now to FIGS. 12 and 13, a third embodiment of the apparatus 100 is shown to include a recoil assist spring 195 which is connected to the rear portion 106 and is adapted to engage each detent 197 of the plate 199 at its respective outer limit. Thereafter, the recoil assist spring 195 provides a recoil force F in a direction of rotation opposite such outer limit, to assist the user in returning from an extreme range of motion.

Figure 17:
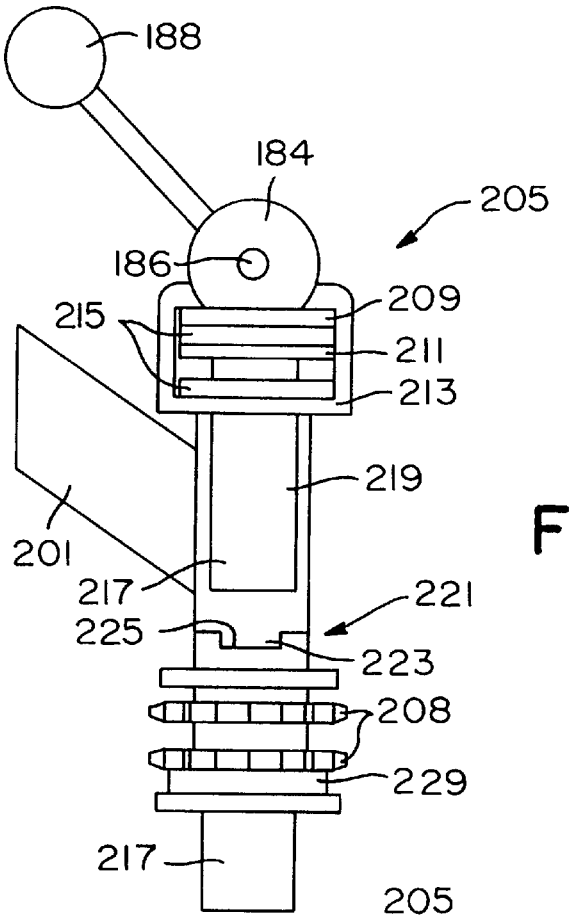
FIG. 17 is a side view, partly in section, of the secondary clutch apparatus shown in FIGS. 14–16, coupled with no resistance.
Figure 18:
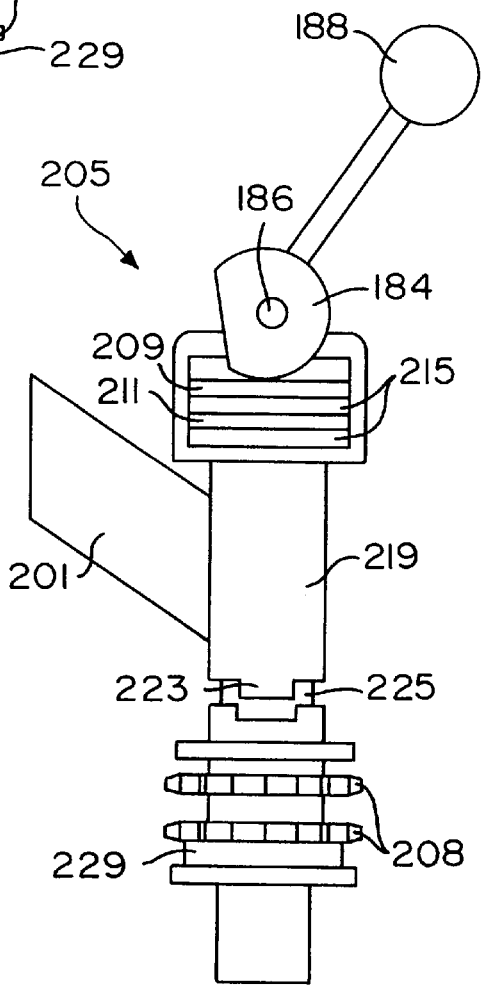
FIG. 18 is a side view of the secondary clutch apparatus shown in FIGS. 14–16, uncoupled and providing resistance.

Yet another embodiment of the present invention is shown in FIGS. 14–18. Such embodiment is, in most respects, substantially similar to the previously described three embodiments, except that it includes a pair of clutches, is capable of coupling and decoupling the front portion 104 from the rear portion 106, and includes chains with sprockets in lieu of cables with pulleys. Referring for the moment to FIGS. 17 and 18, details of a secondary clutch 205 are shown. The secondary clutch 205 serves two functions: (1) to couple and decouple the front portion 104 of the apparatus 100 from the rear portion 106, and (2) to provide resistance for the upper body or front portion 104 of the apparatus 100 when decoupled. A primary clutch 207 (FIGS. 14 and 15) is used for exercising the legs alone or the legs and upper body together.

In addition to the cam 184 which is supported upon axle 186 and engaged by turning the handle 188, secondary clutch 205 includes a cam pressure plate 209 and a spindle clutch plate 211 which sit atop the clutch housing 213 separated by clutch material 215. A spindle 217 is contained within an outer sleeve 219 and is attached at one end to the spindle clutch plate 211 and at its other end to the frame 102. A two-part coupling/decoupling latch 221 is attached to the distal end of the outer sleeve 219, and includes a tooth 223 which is engageable with a notch 225. As can be seen in FIG. 17, the secondary clutch 205 couples the front portion 104 to the rear portion 106 when the cam 184 is disengaged and the tooth 223 engages the notch 225. When the cam 184 is engaged by rotating the handle as shown in FIG. 18, it compresses the cam pressure plate 209 towards the spindle clutch plate 211, and lifts the outer sleeve 219 to free the tooth 223 from the notch 225. With the disengaged cam .184, there is no resistance provided by the secondary clutch 205. However, the engaged cam 184 provides resistance by compressing the clutch material 215.

Referring again to FIGS. 14–16 in addition to FIGS. 17 and 18, it can be seen that the chain 202 is routed from its attachment points 204 at one end of the legs 112, around and engaging respective sprockets 208, past and engaging further sprockets 208 on the primary clutch 207, and finally attached to still further sprockets 208 on the secondary clutch 205. When coupled by the secondary clutch 205, the primary clutch 207 is used to provide resistance to the upper body or front portion 104. As the user rotates the handle bars 110 in the manner previously described with respect to FIG. 6, the chains 202 are likewise rotated about their respective sprockets 208 on the secondary clutch 205. When uncoupled by the secondary clutch 205, resistance is provided for the upper body or front portion 104 by such secondary clutch 205, and the chains 202 will not move about the sprockets 208.

Figure 14:
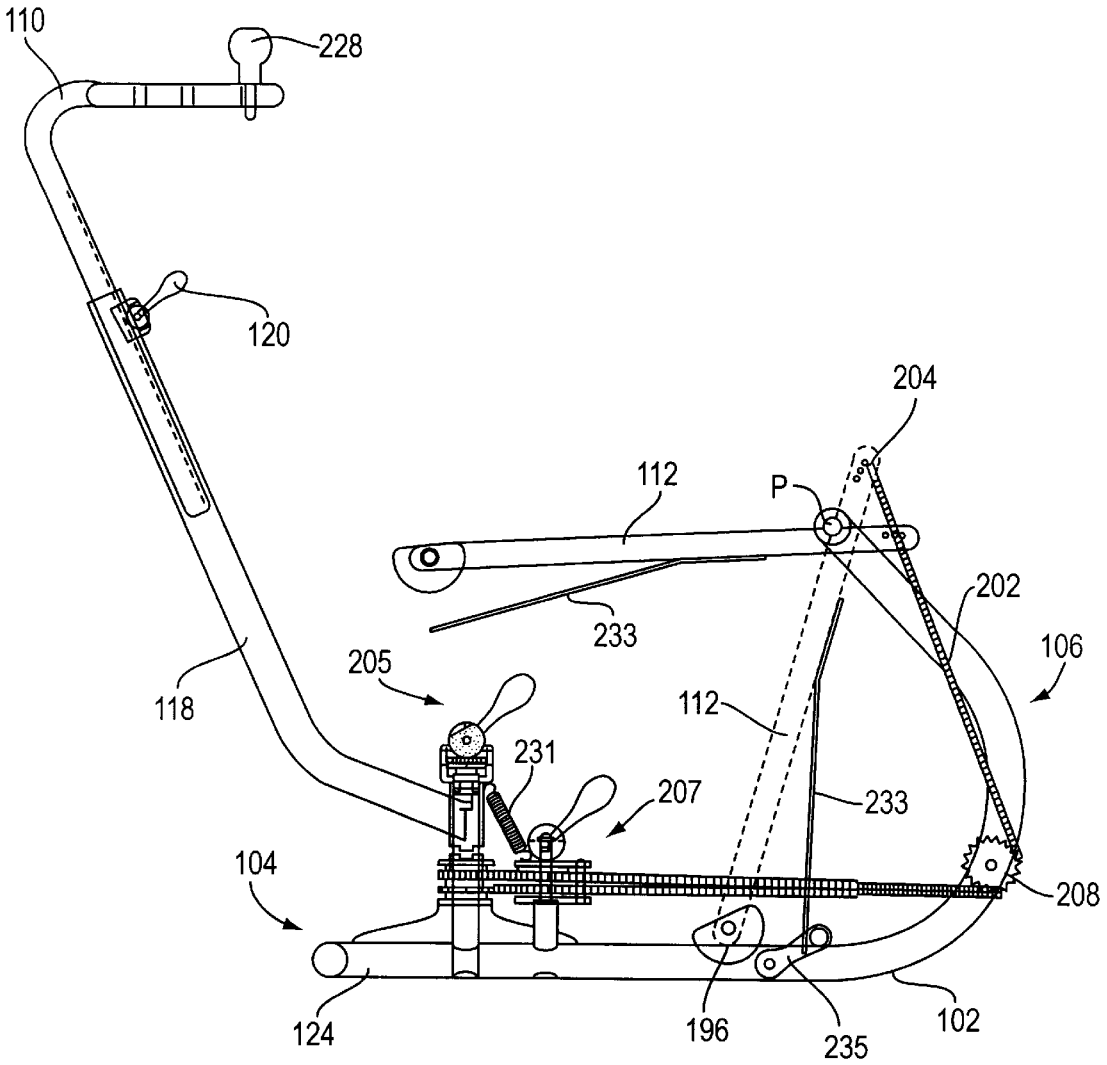
FIG. 14 is a side view of the improved full body exercise apparatus according to yet another embodiment of the present invention.
Figure 15:
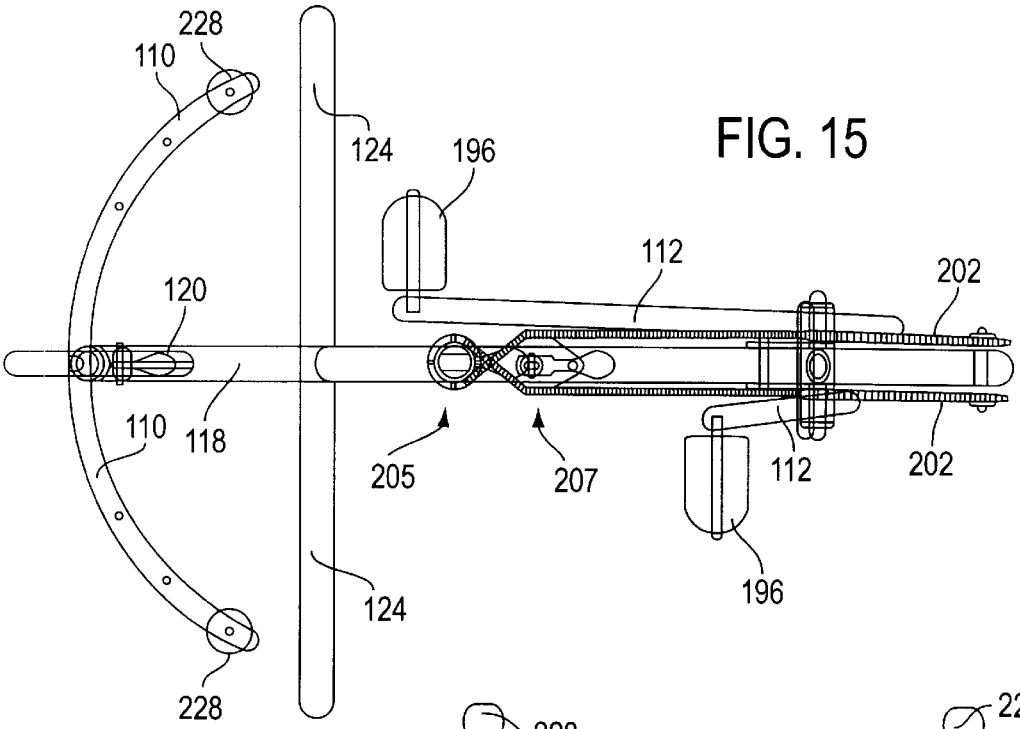
FIG. 15 is a top view of the apparatus shown in FIG. 14.
Figure 16:
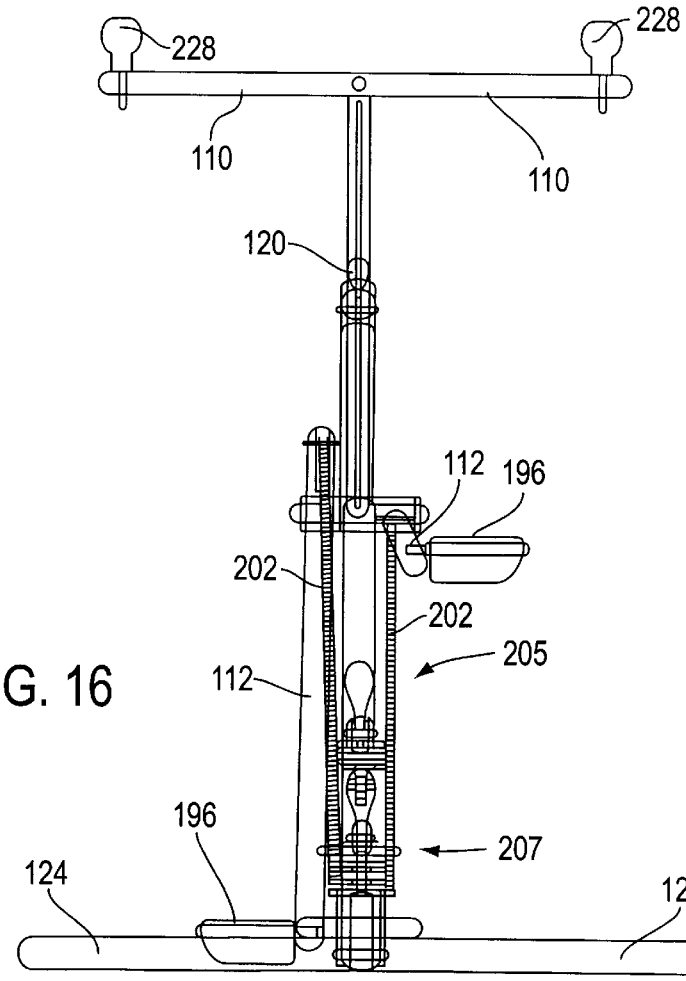
FIG. 16 is an end view of the apparatus shown in FIGS. 14 and 15.

The embodiment shown in FIGS. 14–18 also include recoil assist springs 231, 233 for the front and rear portions 104, 106. The recoil assist spring 231 for the front portion 104 consists of a coil spring attached to the secondary and primary clutches 205, 207. The recoil assist springs 233 for the rear portion 106, however, comprise a leaf spring attached at one end to a respective one of the legs 112 and engaging a stop 235 when the leg 112 is in its fully extended position (FIG. 14).

Figure 19:
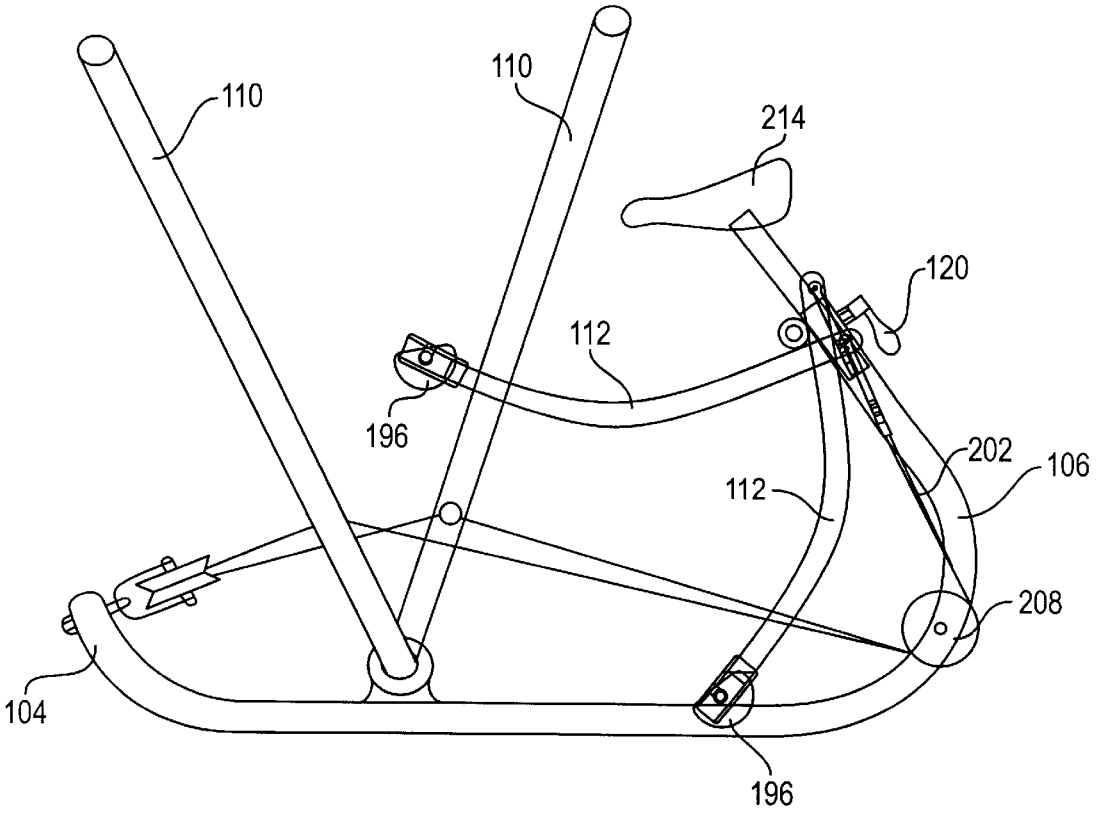
FIG. 19 is a side view of the improved full body exercise apparatus according to a further embodiment of the present invention.
Figure 20:
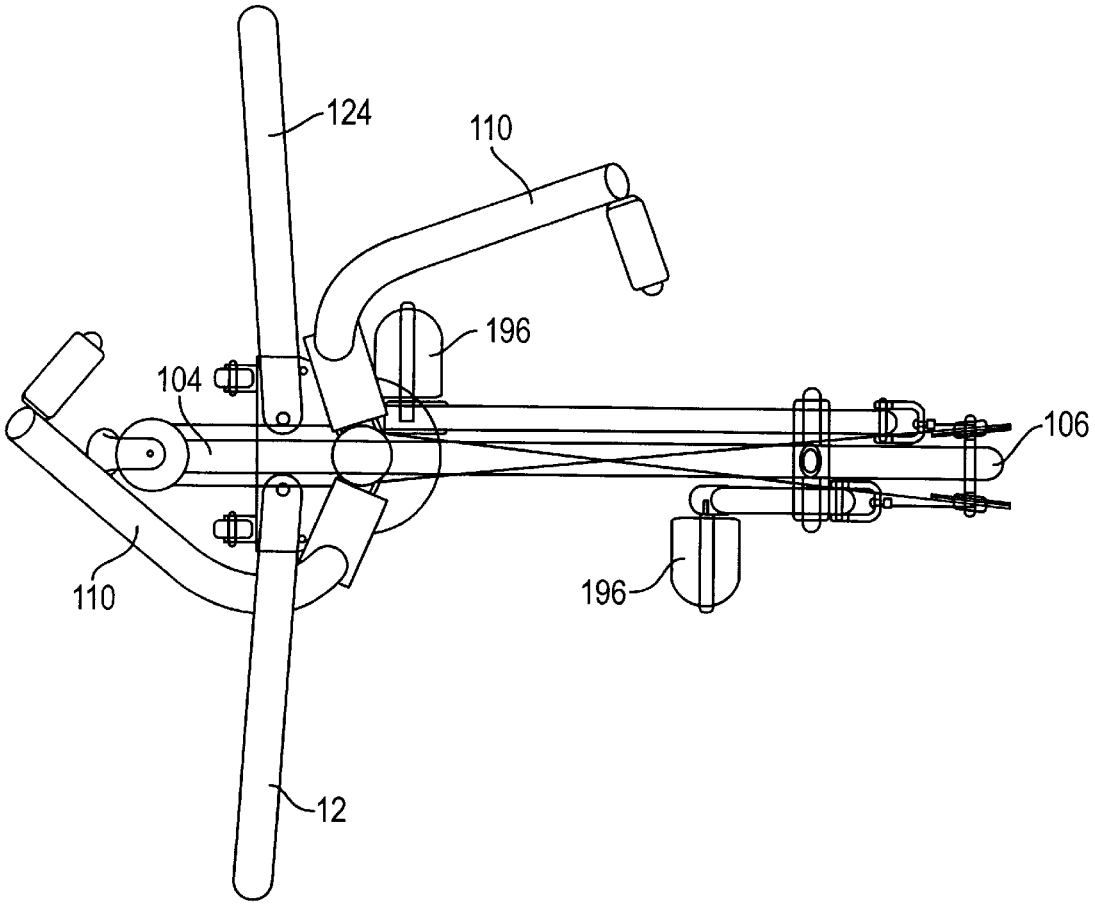
FIG. 20 is a top view of the apparatus shown in FIG. 19.

While specific embodiments of the invention have been shown and described in detail to illustrate the application of the principles of the invention, it will be understood that the invention may be embodied otherwise without departing from such principles and that various modifications, alternate constructions, and equivalents will occur to those skilled in the art given the benefit of this disclosure. As shown in FIGS. 19 and 20, for example, the handle bars 110 may take the form of a push-pull mechanism. The transverse axis would still be positioned relative to the longitudinal axis and the vertical axis to optimize physical workouts of a user of the apparatus. Such a positioning would likewise optimally induce back-and-forth movement of the user's arms in a natural plane not unlike martial arts training or boxing (i.e., punch throwing) when the upper body or front portion 104 of the apparatus 100 is in use. Moreover, during such use-of the front portion 104 to exercise a user's upper body, this positioning of the handle bars 110 substantially rotates the user's torso, further maximizing the overall benefits of the exercise. Apparatus 100 may also include variable resistance means in lieu of the clutches shown by substituting flexible straps, belts, and bands, calipers, brakes, hydraulic cylinders, and electrorheological and/or magnetorheological liquids (i.e., any liquid having the characteristics of changes in viscosity/density as a result of changes in a magnetic field or by application of an electric charge) which would provide resistance for the front and rear portions 104, 106 of apparatus 100. Such resistance could further be made dynamically variable by utilizing the electrorheological and/or magnetorheological liquids in conjunction with a computer-operated application of the magnetic or electrical fields. Moreover, while solid members are preferred for use as the handle bars 110, and the pedal arms 112, tubular members containing metal shot, sand or other suitable weighted material may also be used to provide inertial mass which the user would be forced to overcome during the full body workout. Still further, vertically-oriented handle bars which provide the described motion of a user's arms by rotating about a transverse axis could be substituted for the handle bars 110 shown herein. Thus, the invention is not limited to the specific embodiment described herein, but is defined by the appended claims.

What I claim as my invention is:

1. A full body exercise apparatus, comprising:

a frame with a front portion and a rear portion, said front and rear portions together defining a longitudinal axis;

means for coupling said front portion to said rear portion in rotatable engagement therewith;

a pair of handle bars connected to said front portion and adapted to be rotated about a vertical axis intersecting said longitudinal axis at said coupling means; and a pair of pedal arms, each of which is connected to respective pivot points together defining a transverse axis at a distal end of said rear portion;

wherein said transverse axis is positioned relative to said longitudinal and said vertical axis for optimizing workouts of a user of the apparatus;

wherein said coupling means comprises a variable resistance mechanism; and wherein said variable resistance mechanism comprises:

a spindle tube having an outer surface and an inner surface, wherein said spindle tube is connected at one end thereof to said front portion and said rear portion and includes a plug enclosed its other end;

a first pressure disc having a top surface, a bottom, surface, and a central hole through which said spindle tube extends, wherein said bottom surface is connected to said front portion and said rear portion;

a second pressure disc having a top surface, a bottom surface, and a central hole through which said spindle tube extends;

a clutch disc between said first and second pressure discs;

first bearing means contiguously surrounding said spindle tube along a length of its outer surface extending from said top surface of said first pressure disc to said other end;

an outer sleeve having an inner surface in contiguous contact with said first bearing means, wherein said outer sleeve is connected at one end thereof to said second pressure disc; and means for adjusting pressure exerted by said second pressure disc.

2. The apparatus according to claim 1, wherein said pressure adjusting means comprises:

a cam support connected to said plug;

a first bearing disc having a top surface, a bottom surface, and a central hole through which said cam support extends, wherein said bottom surface is connected to said outer sleeve at its other end;

a second bearing disc having a top surface, a bottom surface, and a central hole through which said cam support extends;

second bearing means between said first bearing disc and said second bearing; and a cam coupled to said cam support and for selectably engaging said top surface of said second bearing disc and causing same to exert pressure through said second bearing means and said first bearing disc, downwardly through said outer sleeve upon said top surface of said second pressure disc.

3. Apparatus for simultaneously exercising the upper and lower body muscle groups of a user, comprising:

a frame with a front portion and a rear portion, said front and rear portions together defining a longitudinal axis;

means for coupling said front portion to said rear portion in rotatable engagement therewith, said coupling means having a vertical axis intersecting said longitudinal axis and said front portion being disposed at an angle to said vertical axis;

a pair of handlebars connected to said front portion and adapted to be rotated about said vertical axis;

a pair of pedal arms, each of which is pivotally connected to respective pivot points together defining a transverse axis at a distal end of said rear portion; and wherein, when in use, said transverse axis is positioned behind and proximate to the users hips.

4. The apparatus according to claim 3, wherein said handle bars are positioned relative to said transverse axis to promote full range movement of the user's arms back-and-forth in a plane substantially parallel to said longitudinal and transverse axes.

5. The apparatus according to claim 4, further comprising means for stabilizing the apparatus in use.

6. The apparatus according to claim 5, wherein said stabilizing means comprises a pair of legs, each of which forms an outwardly extending appendage of said front portion in a substantially orthogonal relationship with said longitudinal axis and said vertical axis.

7. A full body exercise apparatus, comprising:

a frame with a front portion and a rear portion, said front and rear portions together defining a longitudinal axis;

means for coupling said front portion to said rear portion in rotatable engagement therewith, said coupling means having a vertical axis intersecting said longitudinal axis and said front portion being disposed at an angle to said vertical axis;

a pair of handlebars connected to said front portion and adapted to be rotated about said vertical axis, each said handle bar being further adapted to support a hand of a user of the apparatus generally throughout a full range of motion, in a plane, of a respective arm of said user; and a pair of pedal arms, each of which is pivotally connected to respective pivot points together defining a transverse axis at a distal end of said rear portion, each said pedal arm including a pedal rotatably connected to a distal end of said pedal arm and adapted to support a foot of said user generally throughout a full range of motion, in a plane, of a respective leg of said user.

8. The apparatus according to claim 7, wherein said coupling means further includes a variable resistance mechanism.

9. The apparatus according to claim 7, wherein each of said pair of handle bars further comprise:

a hand grip; and receiving means, at a distal end of said handle bar, for variably positioning said hand grip to emphasize one or more selected muscle groups to be exercised by said user.

10. The apparatus according to claim 9, wherein said receiving means comprises a plate having a plurality of holes and said hand grip includes a pin adapted to fit within each said hole.

11. The apparatus according to claim 10, wherein said plate is positionable in a substantially orthogonal relationship with said longitudinal axis and said vertical axis.

12. The apparatus according to claim 10, wherein said pin further comprises means for locking said hand grip in a selected one of said plurality of holes.

13. The apparatus according to claim 7, further comprising means for adjusting said range of motion.

14. The apparatus according to claim 7, further comprising means for independently coupling rotation) of said handle bars and said pedal arms.

15. The apparatus according to claim 7, further comprising means for interdependently coupling rotation of said handle bars and said pedal arms.

16. The apparatus according to claim 7, further comprising means for selectably coupling rotation of said handle bars and said pedal arms.

17. A full body exercise apparatus, comprising:

a frame with a front portion and a rear portion, said front and rear portions together defining a longitudinal axis;

means for coupling said front portion to said rear portion in rotatable engagement therewith;

a pair of handlebars connected to said front portion and adapted to be rotated in an arc about a vertical axis intersecting said longitudinal axis at said coupling means, each said handle bar having a hand grip adapted to support a hand of a user of the apparatus generally throughout a full range of motion, in a plane, of a respective arm of said user and being disposed forward of said vertical axis when said hand grips are arranged in a neutral position; and a pair of pedal arms, each of which is pivotally connected to respective pivot points together defining a transverse axis at a distal end of said rear portion, each said pedal arm including a pedal rotatably connected to a distal end of said pedal arm and adapted to support a foot of said user generally throughout a full range of motion, in a plane, of a respective leg of said user;

wherein said transverse axis is positioned relative to said longitudinal axis and said vertical axis to maximize physical workouts of a user of the apparatus by cooperatively exercising said arms and legs of said user through their full ranges of motion.

18. A full body exercise apparatus, comprising:

a frame with a front portion and a rear portion, said front and rear portions together defining a longitudinal axis;

means for coupling said front portion to said rear portion in rotatable engagement therewith;

a pair of handlebars connected to said front portion and adapted to be rotated in an arc about a vertical axis intersecting said longitudinal axis at said coupling means, each said handle bar being further adapted to support a hand of a user of the apparatus generally throughout a full range of motion, in a plane, of a respective arm of said user;

a pair of pedal arms, each of which is pivotally connected to respective pivot points together defining a transverse axis at a distal end of said rear portion, each said pedal arm including a pedal rotatably connected to a distal end of said pedal arm and adapted to support a foot of said user generally throughout a full range of motion, in a plane, of a respective leg of said user; and a means for adjusting the range of motion of a leg of said user which is interdependently coupled for movement with said coupling means.

19. A full body exercise apparatus, comprising:

a frame with a front portion and a rear portion, said front and rear portions together defining a longitudinal axis;

means for coupling said front portion to said rear portion in rotatable engagement therewith;

a pair of handlebars connected to said front portion and adapted to be rotated about a vertical axis intersecting said longitudinal axis at said coupling means, each said handle bar being further adapted to support a hand of a user of the apparatus generally throughout a full range of motion in a plane of a respective arm of said user;

a pair of pedal arms, each of which is pivotally connected to respective pivot points together defining a transverse axis at a distal end of said rear portion, each said pedal arm including a pedal rotatably connected to a distal end of said pedal arm and adapted to support a foot of said user generally throughout a full range of motion, in a plane, of a respective leg of said user; and a means for creating a recoil force at respective outer limits of a range of motion of said handlebars and said pedal arms.

20. A full body exercise apparatus, comprising:

a frame with a front portion and a rear portion, said front and rear portions together defining a longitudinal axis;

means for coupling said front portion to said rear portion in rotatable engagement therewith;

a pair of handlebars connected to said front portion and adapted to be rotated in an arc about a vertical axis intersecting said longitudinal axis at said coupling means, each said handle bar being further adapted to support a hand of a user of the apparatus generally throughout a full range of motion, in a plane, of a respective arm of said user, said front portion adapted to be rotated through an angle of substantially 180° and concomitantly resulting in the hands of the user rotating around the torso of the user through an angle substantially similar to that circumscribed by said front portion; and a pair of pedal arms, each of which is pivotally connected to respective pivot points together defining a transverse axis at a distal end of said rear portion, each said pedal arm including a pedal rotatably connected to a distal end of said pedal arm and adapted to support a foot of said user throughout a full range of motion, in a plane, of a respective leg of said user.

21. The apparatus according to claim 20, wherein each of said pair of handlebars further comprise:

a hand grip; and receiving means, at a distal end of said handle bar, for variably positioning said hand grip to emphasize one or more selected muscle groups to be exercised by said user.

22. The apparatus according to claim 20, further comprising means for adjusting said range of motion.

23. The apparatus according to claim 22, wherein said pin further comprises means for locking said hand grip in a selected one of said plurality of holes.

24. The apparatus according to claim 23, wherein said receiving means comprises a plate having a plurality of holes and said hand grip includes a pin adapted to fit within each said hole.

25. The apparatus according to claim 20, further comprising means for independently coupling rotation of said handlebars and said pedal arms.

26. The apparatus according to claim 20, further comprising means for interdependently coupling rotation of said handlebars and said pedal arms.

27. The apparatus according to claim 20, further comprising means for selectably coupling rotation of said handlebars and said pedal arms.

28. A full body exercise apparatus, comprising:

a frame with a front portion and a rear portion, said front and rear portions together defining a longitudinal axis;

means for coupling said front portion to said rear portion in rotatable engagement therewith;

a pair of handle bars connected to said front portion and adapted to be rotated about a vertical axis intersecting said longitudinal axis at said coupling means; and a pair of pedal arms, each of which is connected to respective pivot points together defining a transverse axis at a distal end of said rear portion;

wherein said transverse axis is positioned relative to said longitudinal and said vertical axis for optimizing workouts of a user of the apparatus;

means for creating a recoil force at respective outer limits of a range of motion of said handle bars and said pedal arms;

wherein said recoil force means comprises:

a rotational control plate connected to said coupling means for rotation therewith, said rotational control plate including a pair of detents each of which is positioned at a respective one of said outer limits; and a recoil assist spring connected to said rear portion and adapted to engage each said detent at its respective outer limit, said recoil assist spring thereafter providing a bias force in a direction of rotation opposite said outer limit.

* * * * *